US005521327A

United States Patent [19]

Kay et al.

[11] Patent Number: 5,521,327

[45] Date of Patent: May 28, 1996

[54] METHOD AND APPARATUS FOR AUTOMATICALLY PRODUCING ALTERABLE RHYTHM ACCOMPANIMENT USING CONVERSION TABLES

[76] Inventors: Stephen R. Kay, 140 Madison Ave., Westfield, N.J. 07090; Yoshiyuki Igoshi, 1-18-5-104, Wakaba-cho, Chofu-shi, Tokyo, Japan

[21] Appl. No.: 261,059

[22] Filed: Jun. 14, 1994

[30] Foreign Application Priority Data

Jun. 16, 1993 [JP] Japan ..... 5-144946

[51] Int. Cl.[6] ..... G10H 1/40; G10H 7/00

[52] U.S. Cl. ..... 84/635; 84/611

[58] Field of Search ..... 84/611, 635, 651, 84/667, 661

[56] References Cited

U.S. PATENT DOCUMENTS 4,742,748 5/1988 Tateishi ..... 84/611
4,763,554 8/1988 Kozuki ..... 84/611
4,872,385 10/1989 Oguri et al. ..... 84/635
5,001,959 3/1991 Kimpara ..... 84/635
5,177,313 1/1993 Miyamoto ..... 84/611
5,223,655 6/1993 Watanabe et al. ..... 84/637

*Primary Examiner*—William M. Shoop, Jr.
*Assistant Examiner*—Jeffrey W. Donels
*Attorney, Agent, or Firm*—Pollock, Vande Sande & Priddy

[57] ABSTRACT

A rhythm pattern memory having rhythm patterns stored therein, the rhythm patterns being composed of pattern data corresponding to the types of percussion instruments, and a conversion table memory having a plurality of conversion tables for altering sound data each representative of a desired percussion instrument sound to sound data representative of an other percussion instrument sound are provided. A desired percussion instrument sound data in the rhythm pattern selected from the rhythm pattern memory by a rhythm pattern selector is altered to a desired percussion sound data according to the conversion table selected from the conversion table memory by the conversion table selector, and the resulting percussion sound data is converted by a sound source to the corresponding percussion sound signal to be output.

2 Claims, 6 Drawing Sheets

| | SD | RS | CHH | OHH | RCYM | CCYM |
|---|---|---|---|---|---|---|
| Table A | CHH | CHH | -- | -- | -- | -- |
| Table B | RS | -- | -- | -- | -- | -- |
| Table C | RS | -- | RCYM | RCYM | -- | -- |
| Table D | -- | -- | -- | -- | -- | -- |
| Table E | -- | -- | RCYM | RCYM | -- | -- |
| Table F | -- | -- | OHH | -- | -- | -- |
| Table G | -- | -- | -- | CCYM | -- | -- |

SD : SNARE DRUM
RS : RIM SHOT
CHH : CLOSED HI-HAT
OHH : OPEN HI-HAT
RCYM : RIDE CYMBAL
CCYM : CRASH CYMBAL 10
20
RHYTHM PATTERN SELECTOR
30
31
CPU
32
ROM
33
RAM
34
RHYTHM PATTERN MEM
35
INPUT PORT
36
OUTPUT PORT
37
40
41
KEYBOARD SOUND SOURCE
42
ACCOMP SOUND SOURCE
50
51
52
53

CPU
31
REF CLK GEN
39
ROM
32
REG
RAM
33
33R
34
RHYTHM PATTERN MEM
38
A
B
G
OUTPUT PORT
36
INPUT PORT
35
37
30
KEYBOARD SOUND SOURCE
41
ACCOMP SOUND SOURCE
42
40
50
51
52
53
10
RHYTHM PATTERN SELECTOR
20
TABLE SELECTOR
60

| P | R:T:K | PERCUSSIONS |
|---|---|---|
| 1 | 1:1:00 | KICK |
| 2 | 1:1:00 | CLOSED HI-HAT |
| 3 | 1:1:48 | CLOSED HI-HAT |
| 4 | 1:2:00 | SNARE |
| 5 | 1:2:48 | KICK |
| 6 | 1:2:48 | CLOSED HI-HAT |
| 7 | 1:3:00 | KICK |
| 8 | 1:3:00 | CLOSED HI-HAT |
| 9 | 1:3:48 | CLOSED HI-HAT |
| 10 | 1:4:00 | SNARE |
| 11 | 1:4:48 | KICK |
| 12 | 1:4:48 | CLOSED HI-HAT |
| 13 | 2:1:00 | KICK |
| 14 | 2:1:00 | CLOSED HI-HAT |
| 15 | 2:1:48 | CLOSED HI-HAT |
| 16 | 2:2:00 | SNARE |
| 17 | 2:2:48 | KICK |
| 18 | 2:2:48 | CLOSED HI-HAT |
| 19 | 2:3:00 | KICK |
| 20 | 2:3:00 | CLOSED HI-HAT |
| 21 | 2:3:48 | CLOSED HI-HAT |
| 22 | 2:4:00 | SNARE |
| 23 | 2:4:48 | KICK |
| 24 | 2:4:48 | OPEN HI-HAT |

| | SD | RS | CHH | OHH | RCYM | CCYM |
|---|---|---|---|---|---|---|
| Table A | CHH | CHH | -- | -- | -- | -- |
| Table B | RS | -- | -- | -- | -- | -- |
| Table C | RS | -- | RCYM | RCYM | -- | -- |
| Table D | -- | -- | -- | -- | -- | -- |
| Table E | -- | -- | RCYM | RCYM | -- | -- |
| Table F | -- | -- | OHH | -- | -- | -- |
| Table G | -- | -- | -- | CCYM | -- | -- |

SD : SNARE DRUM
RS : RIM SHOT
CHH : CLOSED HI-HAT
OHH : OPEN HI-HAT
RCYM : RIDE CYMBAL
CCYM : CRASH CYMBAL

METHOD AND APPARATUS FOR AUTOMATICALLY PRODUCING ALTERABLE RHYTHM ACCOMPANIMENT USING CONVERSION TABLES

FIELD OF THE INVENTION

This invention relates to an automatic rhythm accompaniment producing apparatus and method to be employed in the electronic musical instruments such as musical synthesizers.

BACKGROUND OF THE INVENTION

FIG. 1 shows a diagrammatical view of the construction of a prior art synthesizer equipped with a rhythm accompaniment apparatus comprising a keyboard 10, a rhythm pattern selector 20, a control section 30, a sound source unit 40 and an amplifier-speaker system 50.

The control section 30 is composed by a so-called microcomputer. As is commonly known, the microcomputer comprises a central processing unit (hereinafter referred to as "CPU") 31, a ROM 32 storing a program for operating the CPU 31 in a predetermined sequence, a RAM 33 used to temporarily store the data input from the keyboard 10 or the rhythm pattern selector 20 and the operational results, an input port 35 and an output port 36. Since the control section 30 in the illustrated example is designed to control a synthesizer equipped with a rhythm accompaniment apparatus, the microcomputer has a rhythm pattern memory 34 added thereto so that rhythm pattern data may be output.

The keyboard 10 and rhythm pattern selector 20 are connected with the input port 35 which in turn inputs the keyboard information and rhythm pattern selection information to the control section 30. The keyboard information is taken through the input port 35 into the CPU 31 at a timing allocated to the position of the associated key as by a key scan signal. In the CPU 31 the keyboard information is decoded and translated to a key code signal which is then input through s bus line 37 and the output port 36 to a keyboard sound source 41 where a musical sound signal having a frequency and a selected and preset tone corresponding to the depressed key is D/A converted to generate an analog signal. The analog musical sound signal output from the sound source unit 40 is then input to an amplifier-speaker system 50 which comprises a mixer 51, an amplifier 52 and a speaker 53 and converts the musical signal to produce a musical sound.

In the rhythm pattern selector 20 on the other hand, a rhythm pattern suitable for any desired type of music such as rock, swing, jazz, waltz, etc. is selected and preset, and a code representing the preset rhythm pattern is input to the CPU 31. The CPU 31 reads the storage region of a rhythm pattern selected from the rhythm pattern memory 34 and outputs the rhythm pattern data through the output port 36 to the accompaniment sound source 42 to generate a sound for rhythm accompaniment.

The accompaniment sound source 42 includes a sound source circuit for generating sounds of various types of musical instruments used for rhythm accompaniment. Sounds of rhythm accompaniment instruments include mainly those of percussion instruments such as snare drums, rim shots, open hi-hats, closed hi-hats, ride cymbals, crash cymbals, etc. Each of the rhythm patterns is predetermined with respect to a particular combination of percussion instruments and the rhythm pattern of the sounds of the respective percussion instruments and is stored in the rhythm pattern memory 34. Upon selecting a particular rhythm pattern, the rhythm pattern data of the associated percussion instruments are transmitted to the accompaniment sound source 42 where they are converted to signals of the sounds of the percussion instruments in the selected combination and are output to the amplifier-speaker system 50.

The rhythm pattern data stored in the rhythm pattern memory 34 are composed of sound data for designating the type of percussion sounds to be generated and the set of timing data to generate the percussion sounds. As a matter of convenience, the same key codes as some of the key codes allocated to the keys of the keyboard 10 are employed as the percussion sound data and the type of percussion sounds is designated by the key codes. Discrimination between the key codes used for the accompaniment information and the key codes for the keyboard keys is effected by the transmitting timings.

As indicated above, in the conventional automatic rhythm accompaniment producing apparatus, the rhythm pattern memory 34 has only one combination of percussion instruments suitable for each of the rhythm patterns stored therein. Accordingly, it has the disadvantage that the accompaniment cannot be subtly varied within the same musical piece. If the rhythm accompaniment is to be altered between gentle and intense sections in the same musical piece, the rhythm accompaniment itself must be selected again. On this account, it would be convenient in a musical performance to provide a number of different rhythm pattern data involving combinations of percussion instruments having some of the instruments replaced with others for various types of music. However, the provision of many different rhythm pattern data having different combinations of percussion instruments would undesirably cause an excessive increase in the memory capacity of the rhythm pattern memory 34, resulting in an increase in cost.

SUMMARY OF THE INVENTION

Accordingly, it is an object of this invention to provide a method for producing a number of rhythm patterns having different combinations of percussion instruments without an incidental rise in cost, and an automatic rhythm accompaniment apparatus utilizing the method.

In this invention, there is provided a conversion table memory in which there are stored a plurality of conversion tables for altering sound data representative of each of a number of percussion instruments as read out of a rhythm pattern memory to sound data representative of another one of the percussion instruments. It is determined by a conversion table selector which one of the group of conversion tables is to be selected for use.

According to this invention, it is possible to change the combinations of percussion instruments simply by changing the conversion tables while the data of the same rhythm pattern is being read. With this arrangement, it is possible to vary the tune of accompaniment even within the same playing pattern by changing the combinations of percussion instruments. It is to be appreciated that only a small memory capacity is required for the group of conversion tables without a significant increase in cost. The present invention thus provides an inexpensive and easy-to-operate automatic rhythm accompaniment apparatus.

DETAILED DESCRIPTION OF THE PREFERRED EMBODIMENTS

Figure 1:
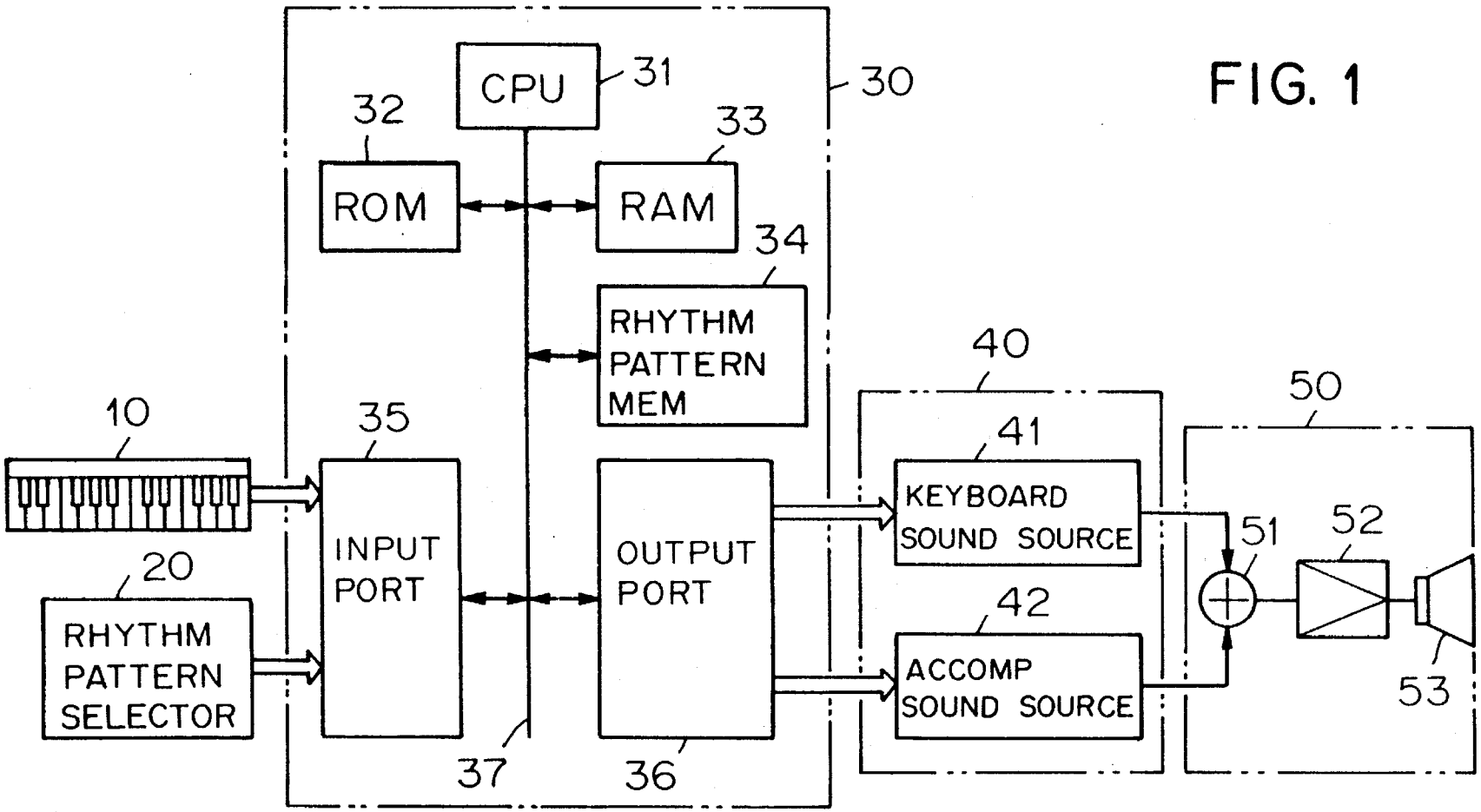
FIG. 1 is a block diagram of a synthesizer having a prior art automatic rhythm accompaniment apparatus.
Figure 2:
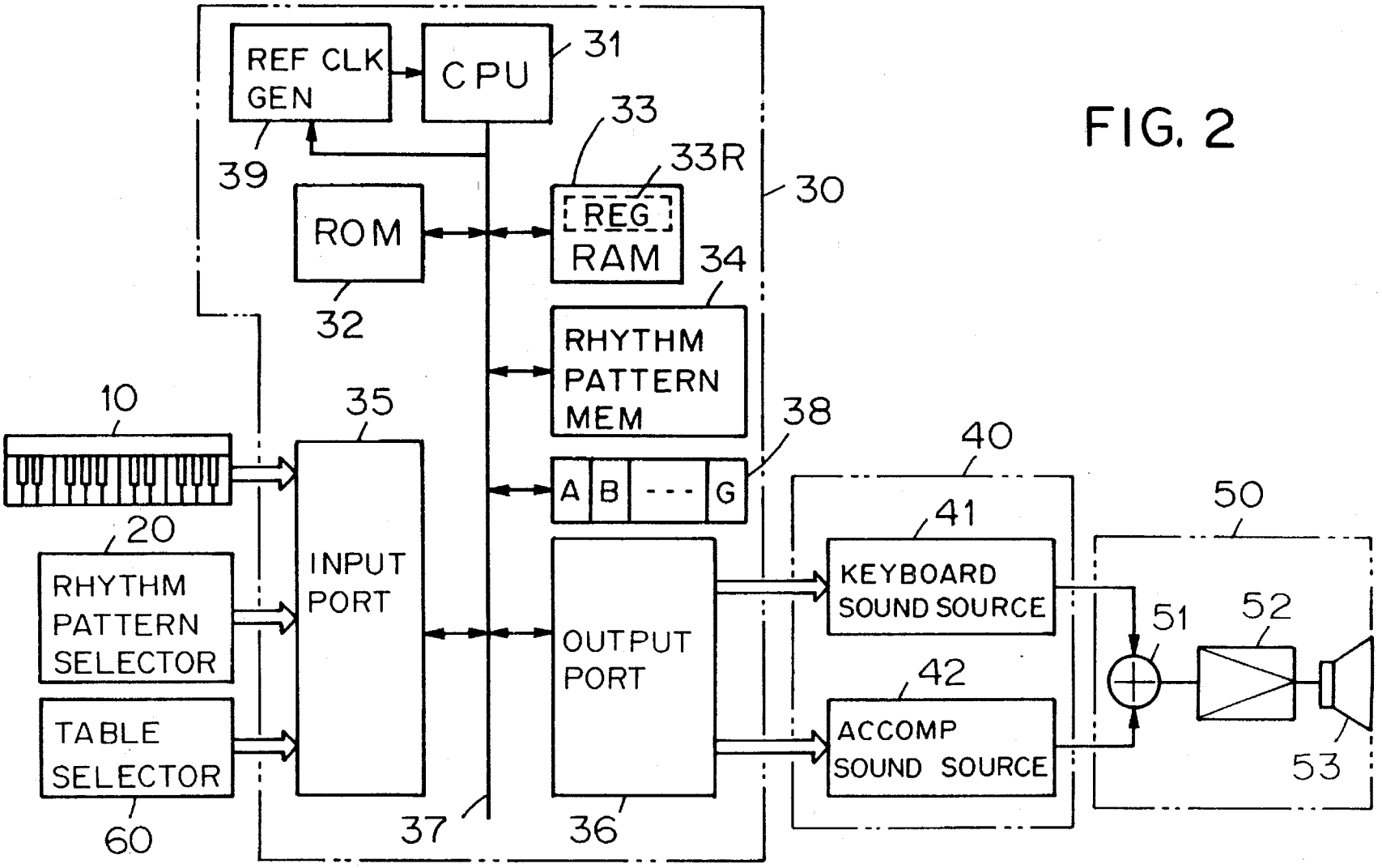
FIG. 2 is a block diagram illustrating the arrangement of a synthesizer having an automatic rhythm accompaniment apparatus according to this invention.

Referring to FIG. 2, there is shown an embodiment of the automatic rhythm accompaniment producing apparatus according to this invention wherein the parts thereof that are similar to like parts of the apparatus of FIG. 1 previously described are indicated by like reference numerals.

This invention is characterized by a conversion table memory 38 incorporated in the control section 30 and a conversion table selector 60. The conversion table memory 38 has stored therein a plurality of conversion tables for altering a key code allocated to each of a number of percussion instruments as read out of a rhythm pattern memory 34 to a key code for of another one of the percussion instruments. The conversion table selector 60 provided at the input side of the control section 30 is to select which one of the group of conversion tables is to be used.

While the rhythm accompaniment performance according to this invention will be described below, the embodiment of FIG. 2 is configured as a synthesizer in which a keyboard 10 for playing melodies and the corresponding sound source 41 are provided, as is the case with the prior art apparatus shown in FIG. 1.

Figures 3A, 3B:
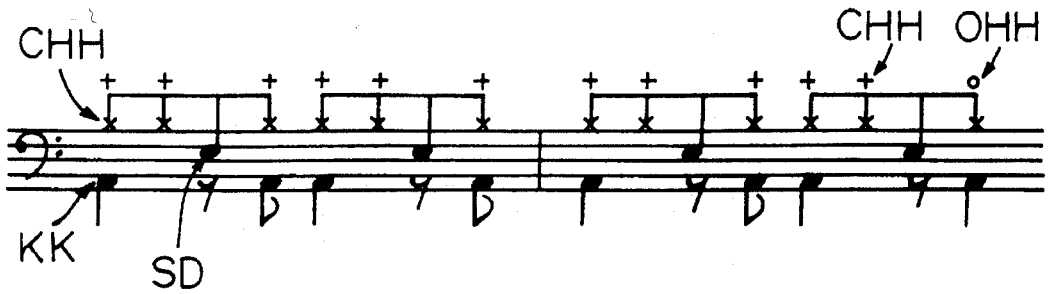
FIG. 3A shows an example of the rhythm pattern data.
FIG. 3B shows a music sheet corresponding to the rhythm pattern data of FIG. 3A.

Prestored in the rhythm pattern memory 34 are various types of rhythm pattern data corresponding to the type of music being played such as rock, jazz, swing, etc. An example of such rhythm pattern data is shown in FIG. 3A. This series of rhythm pattern data is established as data for 16 bars and is to be repeatedly used.

FIG. 3B is a musical note representing an example of rhythm accompaniment actually played on two bar sections of the series of rhythm pattern data shown in FIG. 3A. As seen in FIG. 3A, the rhythm pattern data are each composed of a set of sound data (represented by the same code as one of the predetermined key codes for the keyboard keys as stated before) for designating the type of percussion sound to be generated such as kick, closed hi-hats, open hi-hats and so on and generation timing data for designating the timing of generating the sound. Each generation timing data is represented by a set (R:T:K) of the bar number R in which to produce the sound, the beat number T and the clock number K. The example of rhythm pattern data shown in FIG. 3A is based on a 4/4 beat with one beat (♩) defined by a length of 96 clocks. Accordingly, every 97th clock will be the next best, and the fifth best will be the first beat of the next bar. The series of rhythm pattern data in the rhythm pattern memory 34 are stored in the addresses corresponding to the pointers P designating the respective data.

In the example of FIG. 3B, the kick KK expressed a note A in the music sheet and the closed hi-hat CHH expressed as a note B are produced as the sounds of the first beat of the first bar. The generation timings (R:T:K) of these sounds are (1:1:00) as indicated at the pointers 1 and 2 in FIG. 3A. The generation timing a half beat thereafter is indicated by clock K=48 at the pointer P=3 which is expressed as the second closed hi-hat CHH in FIG. 3B. The sign added on the top of the hi-hat symbol in FIG. 3B stands for the closed hi-hat CHH while the affixed° sign stands for the open hi-hat OHH. The symbol indicated as a note E represents the snare drums.

Figures 4, 5:
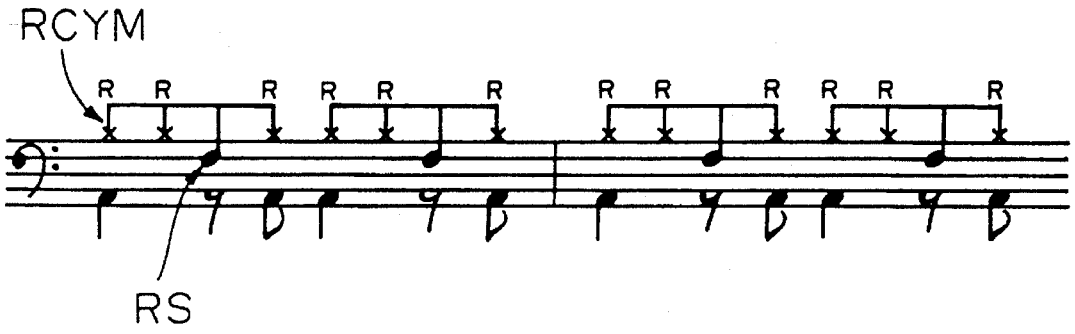
FIG. 4 shows an example of the conversion tables.
FIG. 5 is a representation by a music sheet of the rhythm pattern data of FIG. 3A which has been modified by the conversion table C.

FIG. 4 illustrates a plurality of conversion tables stored in the conversion table memory 38. In this example there are seven conversion tables A–G. If the conversion table A for instance is selected, the snare drum SD and the rim shot RS among the percussion sound data read out of the rhythm pattern memory 34 are both altered to the closed hi-hat CHH while the other percussion instrument sound data are output without being altered. If the conversion table C is selected, among the percussion sound data read out of the rhythm pattern memory 34 the snare drum SD is altered to the rim shot RS and both the closed hi-hat CHH and the open hi-hat OHH are altered to the ride cymbal RCYM while the other percussion sound data are output without being altered. In the illustrated conversion tables A–G, if the original rhythm pattern data (stored in the rhythm pattern memory 34) are of s drum pattern fundamental in s sense which is based on snare drums and hi-hats, there is a tendency of the accompaniment changing progressively from a gentle to intense one as it proceeds from the table A to G.

FIG. 5 is a music sheet representing the sounds of the accompaniment percussion instruments being generated as the percussion sound data in the rhythm pattern data of FIG. 3A are modified when the conversion table C is selected. Every snare drum SD in FIG. 3B is altered to the rim shot RS expressed as a note F. Every closed hi-hat CHH and open hi-hat OHH in FIG. 3B is altered to the ride cymbal RCYM (expressed by the symbol ⁎having the letter R added on the top thereof).

Figure 6:
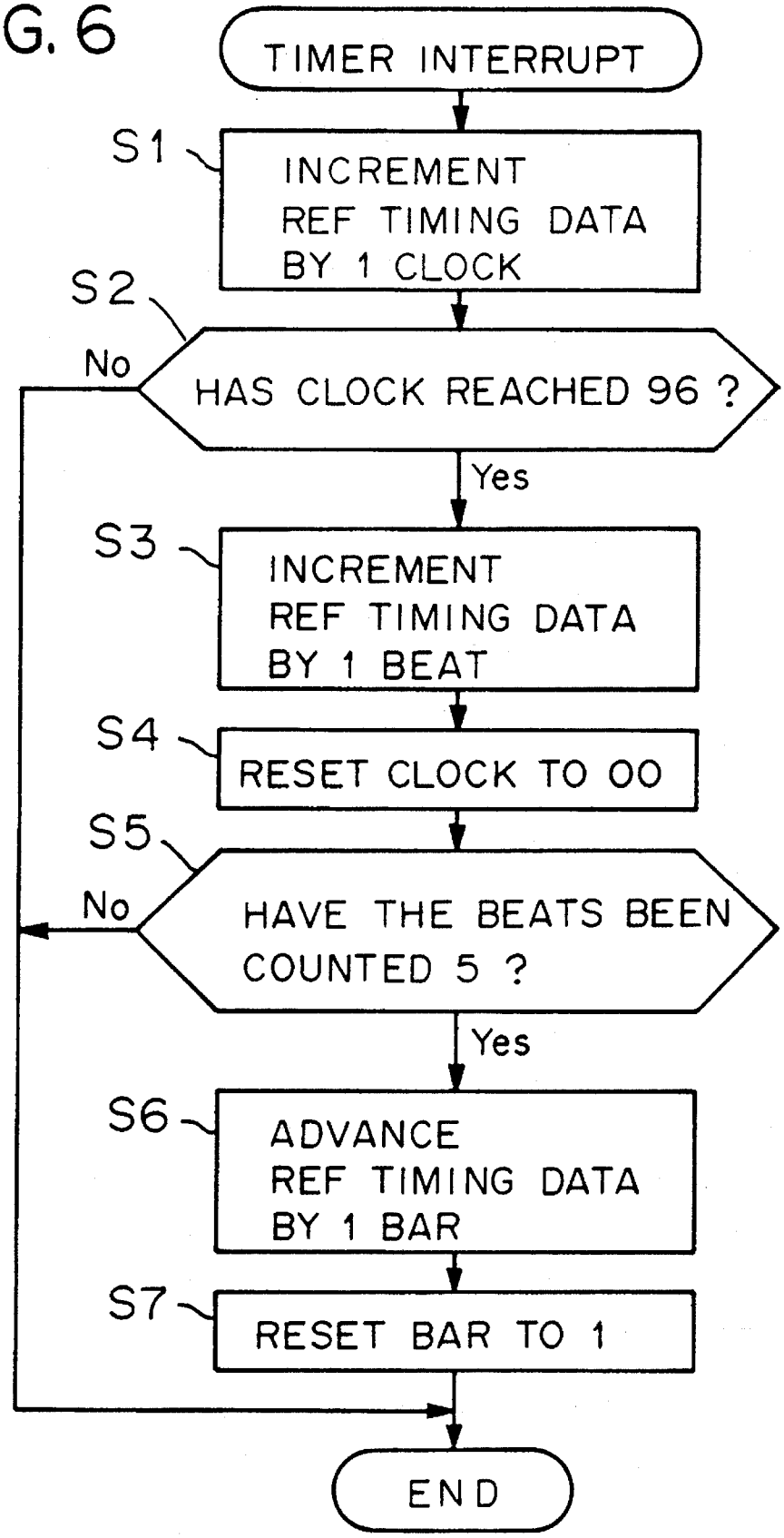
FIG. 6 is a flow chart of the process for producing the reference timing data.

FIG. 6 shows the process of producing the reference timing data which constitute bases for the timings of generating sounds according to the rhythm of the music. The CPU 31 performs the process each time the CPU is provided with a reference clock CK as an interrupt signal of a fixed period from a reference clock generator 39 shown in FIG. 2. The reference clock generator 39 is constructed as a counter for generating one reference clock each time a predetermined number of high-rate operation clocks (not shown) for operating the CPU 31 are counted. The predetermined number may arbitrarily be selected. In this example, the period of the reference clock CK is set at 1 beat/96. A predetermined address in the RAM 33 is used as a register for holding the reference timing data (R:T:K). The reference timing data (R:T:K) in the register 33R is initially preset to (1:1:00) through the rhythm pattern reproducing process of FIG. 7 as will be discussed later.

In the step S1, the CPU 31 increments by one the clock count K in the reference timing data (R:T:K) in the register 33R upon receiving a clock of 1 beat/96 period as an interrupt signal from the reference clock generator 39. The next step S2 is to check if the clock count K in the reference timing data (R:T:K) in the register 33R has reached 96, and if not, the CPU terminates the process and awaits an interrupt by the next reference clock CK.

Upon the clock count K reaching 96 by the process of step S1 being carried out 96 times, the beat count T in the reference timing data (R:T:K) of the register 33R is advanced by one in the step S3, and the clock count K is reset to 00 in the step S4.

In the next step S5 it is checked if the beat count T in the reference timing data (R:T:K) in the register 33R has reached the number of beats in one bar plus 1 (4+1=5 in the case of the music played being at 4/4 beat, for example), and if not, the process is terminated to await an interrupt. If yes, the process proceeds to the step S6 in which the bar count R in the reference timing data of the register 33R is incremented by one, and then in the step S7 the beat count T is reset to 1 and the process is terminated.

Figure 7:
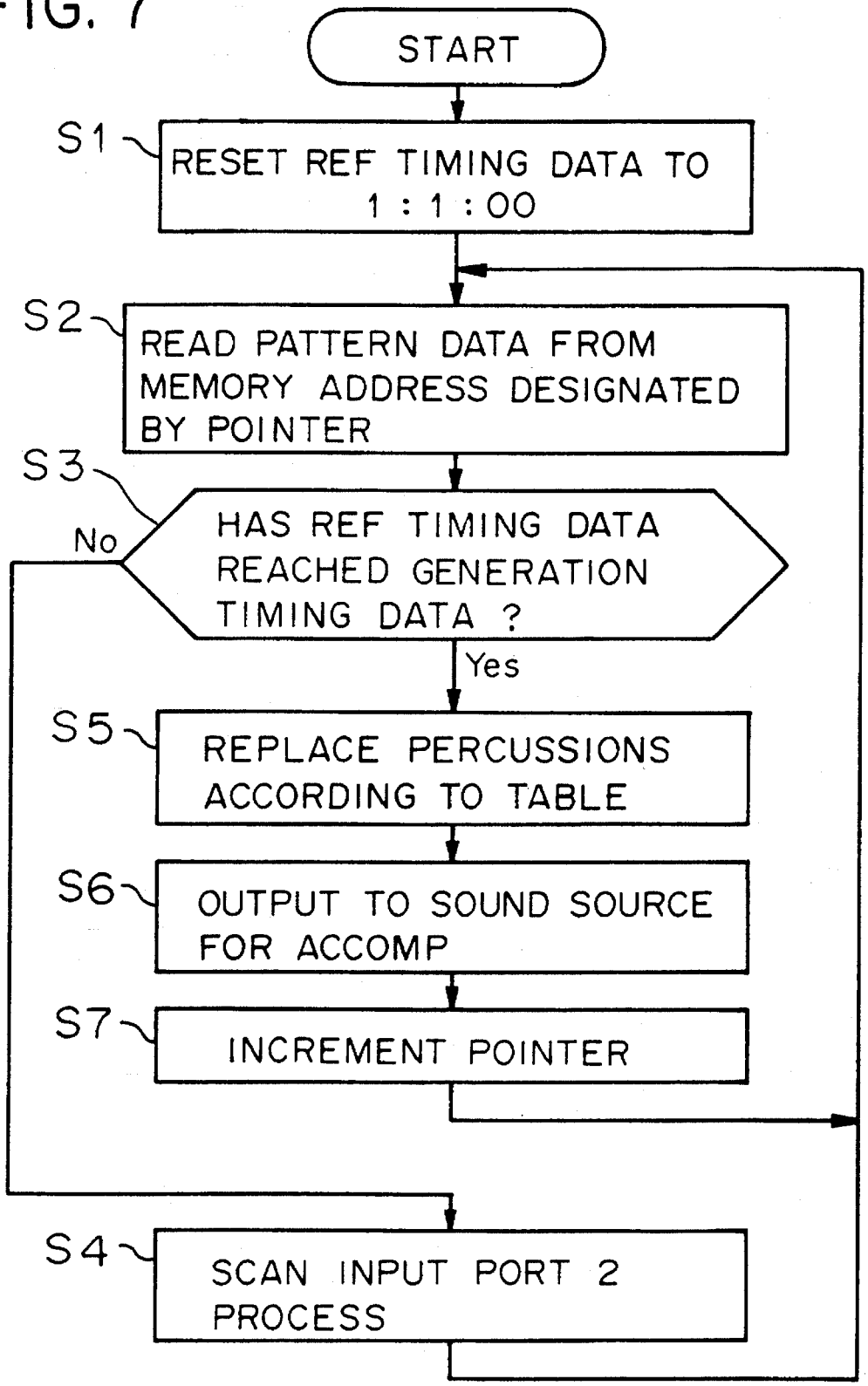
FIG. 7 is a flow chart of the process for reproducing the rhythm pattern.

FIG. 7 shows the process that the CPU 31 performs to produce the accompaniment sounds. Upon the apparatus being turned on, the reference timing data (R:T:K) in the register 33R are set at an initial value (1:1:00) while at the same time the pointer P is set at 1 in the step S1.

The next step S2 is to read out the pattern data from the address in the rhythm pattern memory 34 designated by the pointer P. In the example of FIG. 3A, the generation timing data (1:1:00) and percussion sound data "kick" are read out.

In the step S3, the generation timing data is compared with the reference timing data held in the register 33R at that time, and if the reference timing data has not reached the generation timing data (1:1:00), the process is advanced to the step S4 in which the input port 35 is scanned. If there is any input, the process instructed by the input is carried out. By way of example, if a change is made in the choice of the conversion tables by the conversion table selector 60, the code designated thereby is taken into the CPU 31. Alternatively, if there is any key operated on the keyboard 10, the code corresponding to the key is taken into the CPU 31 which in turn provides it to the keyboard sound source 21 through the output port 36. Upon completion of the step S4, the process is returned to the step If the reference timing data has reached the generating timing data in the step S3, the process is advanced to the step S5 in which the conversion table in the conversion table memory 38 preselected by the conversion table selector 60 is referred to. And if the percussion sound data read out in the step S2 is an object to be altered, that original data is replaced with the data designated by said conversion table, and then in the step S6 the designated data which replaced the original data is supplied through the output port 36 to the accompaniment sound source 42 to generate the corresponding percussion sound. In the step S7 the pointer P is advanced by one step and then the process is returned to the step S2.

It should here be noted that the processing time required for the process of FIG. 7 is on the order slightly exceeding one period of the reference clock even for the longer process (the loop including the step S4) and less than the reference clock period for the shorter loop including the steps S5, S6 and S7 since the process program of FIG. 7 is executed by the CPU 31 under the control of the high-rate clock.

Although the pattern data designated by the pointers 1 and 2 are shown to be of the same generating data (1:1:00) in the example of FIG. 3A, the processing shown in FIG. 7 would cause the percussion sound corresponding to the pattern data designated by the pointer 2 to generate after the percussion sound corresponding to the pattern data designated by the pointer 1 has been generated. However, the time delay would be on the order of the time required for one processing loop in the process of FIG. 7, that is, at most one reference clock period. In the example discussed above, this time delay is so short as not to be perceptible to the human ear since the period of the reference clock is selected to be one beat/96.

Thus, while the reference timing data are successively generated to suit the music being played according to the processing shown in FIG. 1 on one hand, the pattern data designated by the pointer P shown in FIG. 3A are read out of the rhythm pattern memory 34 according to the processing shown in FIG. 7 on the other hand. If the generation timing data in the pattern data has reached the reference timing data within the register 33R produced by the processing shown in FIG. 6, the sound designated by the percussion sound data in the pattern data is about to be generated, but if at that time the percussion sound about to be generated is an object to be altered by the selected conversion table, said original percussion sound data is replaced with the percussion sound data designated by the conversion table.

Both the percussion sound data altered by the conversion table and the percussion sound data unaltered are transmitted through the output port 36 to the accompaniment sound source 42 where each percussion sound data are converted to the musical sound signal of the corresponding percussion instrument, which are then reproduced as percussion sounds at the amplifier-speaker system 50.

From the foregoing description, it can be appreciated that according to the teachings of this invention, the addition of no more than the conversion table memory 38 and the conversion table selector 60 permits each of the rhythm patterns stored in the rhythm pattern memory 34 to produce an accompaniment having the same rhythm pattern but different feelings by utilizing a desired one of the conversion tables A to G. Accordingly, it is possible to make a free choice between changing the accompaniment from gentle to intense sections within the same music piece and effecting the accompaniment as it has the original feeling as read out of the rhythm pattern memory 34. It is thus possible to alter a single rhythm pattern in several times as many modes as the number of tables in the conversion table memory 38.

And yet, the addition of the conversion table memory 38 results in no significant rise in cost since it may comprise a small capacity memory. It is thus to be understood that the present invention provides an automatic accompaniment apparatus which is inexpensive but capable of a wide selection of rhythm patterns.

While the invention has been described as an automatic rhythm accompaniment apparatus built in a synthesizer in the illustrated embodiment, it will be understood that the invention may be embodied as an independent automatic rhythm accompaniment apparatus.

We claim:

1. A rhythm accompaniment apparatus for automatically producing real time alterable percussion sound signals, comprising:

a rhythm pattern memory having a plurality of rhythm patterns stored therein, said rhythm patterns being composed of a series of pattern data each containing a sound data for designating a type of percussion sound to be generated;

rhythm pattern selecting means for selecting and reading out the rhythm patterns stored in said rhythm pattern memory;

a conversion table memory having a plurality of conversion tables for altering sound data representative of at least one percussion instrument sound as read out of said rhythm pattern memory to sound data representative of a different percussion instrument sound;

conversion table selecting means for selecting a conversion table from said conversion table memory;

control means for reading out rhythm pattern data of a rhythm pattern selected from said rhythm pattern memory by said rhythm patter selecting means, said control means being operable, if the sound data of said selected rhythm pattern data is an object to be altered by the conversion table selected by said conversion table selecting means, to effect real time replacement of said sound data with the sound data designated by said selected conversion table, and said control means being operable to output the sound data intact if the sound data of said selected rhythm pattern data is not an object of alteration; and sound source means for receiving successively sound data output from said control means and converting the sound data to corresponding percussion sound signals to be output.

2. A method for producing rhythm accompaniment sounds in an automatic rhythm accompaniment apparatus including a rhythm pattern memory having a plurality of rhythm patterns stored therein, said rhythm patterns being composed of a series of pattern data each containing a sound data for designating a type of percussion sound to be generated, and a conversion table memory having a plurality of conversion tables for altering sound data each representative of at least one percussion instrument sound as read out of said rhythm pattern memory to sound data representative of another percussion instrument sound, said method comprising the steps of:

(a) reading out a series of pattern data of a selected rhythm pattern successively from said rhythm pattern memory;

(b) referring to a selected one of the conversion tables in said conversion table memory, and if the sound data of said pattern data read out of said rhythm pattern memory is an object to be altered by the selected conversion table, effecting real time replacement of said sound data with different sound data designated by said selected conversion table and outputting said different sound data, and if the sound data of said pattern data read out of said rhythm pattern memory is not an object of alteration, outputting the sound data intact; and (c) converting the sound data output in step (b) to a corresponding percussion sound signal.

* * * * *